United States Patent [19]

Yanagihara

[11] Patent Number: 4,747,162

[45] Date of Patent: May 31, 1988

[54] DISPOSABLE PERSPIRATION ABSORBING PAD

[76] Inventor: Fumie Yanagihara, 4-10-16 Kugayama, Suginami-ku, Tokyo, Japan

[21] Appl. No.: 33,337

[22] Filed: Mar. 31, 1987

[30] Foreign Application Priority Data

Apr. 1, 1986 [JP] Japan ..... 61-47057[U]

[51] Int. Cl.[4] ..... A41D 27/12

[52] U.S. Cl. ..... 2/53; 2/56; 2/58

[58] Field of Search ..... 2/53, 54, 55, 56, 57, 2/58

[56] References Cited

U.S. PATENT DOCUMENTS

| | | | |
|---|---|---|---|
| 1,108,427 | 8/1914 | Brennan | 2/53 |
| 3,156,924 | 11/1964 | Wonacott | 2/53 |
| 3,588,916 | 6/1971 | Glatt | 2/53 |
| 3,727,237 | 4/1973 | Glatt | 2/56 |
| 3,885,247 | 5/1975 | Kost | 2/55 |
| 4,485,492 | 12/1984 | Sneider | 2/53 |
| 4,545,080 | 10/1985 | Gorham | 2/54 |
| 4,631,752 | 12/1986 | Heyman | 2/56 |
| 4,663,780 | 5/1987 | Rawlings et al. | 2/53 |

*Primary Examiner*—Louis K. Rimrodt

*Attorney, Agent, or Firm*—Michael N. Meller

[57] ABSTRACT

A perspiration absorbing pad capable of easily preventing clothes from being stained with perspiration. The pad includes a body made of a material which is thin, has softness, stretching properties and flexibility and is excellent in moisture absorbing properties, the body having sufficient dimensions to cover any portion of the clothes which is subject to a stain of perspiration, an active adhesive applied to one surface of the body, and a release paper covering the adhesive coated surface. The pad is usable as a disposable pad.

10 Claims, 2 Drawing Sheets

DISPOSABLE PERSPIRATION ABSORBING PAD

BACKGROUND OF THE INVENTION

The present invention relates to a perspiration absorbing pad which prevents perspiration from sticking to and staining one's clothes.

In the past, only the application of an antiperspirant cream to the skin has been practiced in an attempt to prevent the underwear or coat from being stained with perspiration.

In the summer period, much perspiration takes place particularly under the arms and at the back of the neck so that the antiperspiration cream causes the perspiration to stick to the clothes and become sticky and unpleasant, thus causing discoloration of the clothes in extreme cases. In the case of a journey, one must carry many spare clothes and the shirts or the like must frequently be sent to the cleaners.

SUMMARY OF THE INVENTION

It is an object of the present invention to provide a perspiration absorbing pad which is designed to be disposable.

It is another object of the invention to provide a perspiration absorbing pad sufficient to cover any portion of the clothes which is likely to be stained with perspiration.

It is still another object of the invention to provide a perspiration absorbing pad including a body portion made of a material which is thin, has softness, stretching properties and flexibility and is excellent in moisture absorption properties.

It is still another object of the invention to provide a perspiration absorbing pad so designed that one surface of its body is coated with an active adhesive and the adhesive coated surface is covered with a release paper.

In one form of this invention, a perspiration absorbing pad is a disposable pad which is excellent in moisture absorption properties, easily detachable, low in cost and adapted to be self-adhesive to any portion of the clothes which is likely to be stained with perspiration so as to absorb the perspiration and one surface of the pad is coated with an active adhesive and the coated surface is covered with a release paper.

Thus, in accordance with the invention, the perspiration absorbing pad is adhered to any portion of the clothes which is likely to be stained with perspiration, whereby it is possible to absorb the perspiration to completely prevent the clothes from being stained with the perspiration.

The perspiration absorbing pad according to the invention has its body made of a material which is thin, has softness, stretching properties and flexibility and is excellent in moisture absorption, such as, home tissue paper, cut absorbent cotton, nonwoven fabric or synthetic paper and therefore the perspiration can be absorbed fully. As a result, by preliminarily adhering the pad to each of those portions of the clothes to be impregnated with perspiration, the perspiration is prevented from directly passing through the clothes and staining them. Also, the excellent softness of the pad makes the clothes comfortable to wear and the number of times of washing is reduced with the resulting improvement in economy. In addition, coloring, e.g., yellowing of the clothes due to the perspiration can be prevented. Further, when the pad is impregnated with the perspiration considerably, it is only necessary to replace the pad with a new one and to dispose of the worn pad. Thus, the pad of this invention is simple in construction, low in material cost, available inexpensively and freely usable as a disposable one. Also, since the pad is not bulky and handy to carry with one and it can be used by simply stripping off the release paper by hand and adhering it to the back of the clothes, it is convenient to use and capable of preventing any staining of the clothes, thus making it handy and effective in reducing the number of spare clothes to be carried with one when making a journey.

The above-mentioned and other features and objects of the invention and the manner of attaining them will become more apparent and the invention itself will be best understood by reference to the following description of some embodiments of the invention taken in conjunction with the drawings.

DESCRIPTION OF THE PREFERRED EMBODIMENTS

Figure 1A:
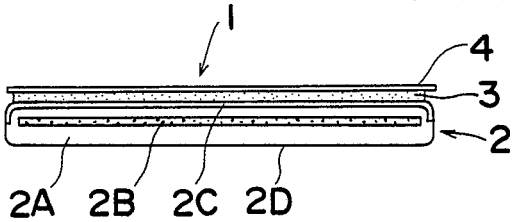
FIGS. 1*a*, 1*b*, and 1*c* are schematic diagrams showing in section a perspiration absorbing pad according to the present invention.
Figure 1B:
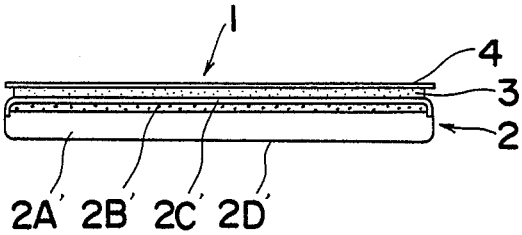
Figure 1C:
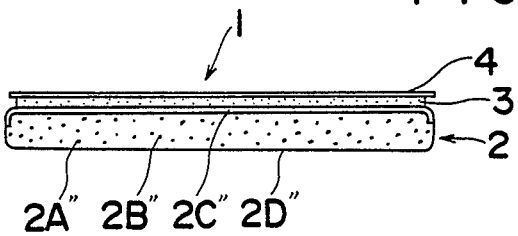

Referring to FIG. 1 showing a partial sectional view of a perspiration absorbing pad 1 embodying the present invention, the pad 1 is constructed so that it is thin, has softness, stretching properties and flexibility and is excellent in moisture absorbing properties and pad 1 will now be described in greater detail with reference to the Figure. More specifically, the construction of the pad 1 includes a pad body 2 and adhesive means 3, and a release paper 4 is provided to cover the adhesive means 3 in the unused state of the pad 1. Thus, the pad 1 is used by stripping off the release paper 4 and attaching the pad 1 to the desired position on one's clothes by means of the adhesive means 3. The pad body 2 is constructed so that at least one layer of cotton or water absorbing paper (2A, 2A' or 2A'') and a layer composed of water absorbing high-molecular substance (2B, 2B' or 2B'') in powder or sheet form are formed into substantially an oval shape and its whole exterior surface is covered with a nonwoven fabric or water absorbing paper 2D having a waterproof film 2*c* formed on one of its surface which contacts the clothes. The adhesive applied to the adhesive means 3 is an active adhesive and an epoxy resin or the like should preferably be used. Also, with this pad body 2, the water absorbing high-molecular substance in powder or sheet form may be water absorbing high-molecular substance of the starch-acrylonitrile type, polyacrylic acid type, starch-acrylic acid type or the like and it may be arranged within the pad body 2 by any of various methods depending on conditions. In other words, in FIG. 1*b*, a layer of water absorbing high-molecular substance in power or sheet form is arranged to adjoin the inner side of a waterproof film. In FIG. 1*a*, a water absorbing high-molecular substance in powder or sheet form is arranged between at least two layers of cotton or water absorbing paper on the inner side of a nonwoven fabric or water absorbing paper convering the whole exterior surface. In FIG. 1c, a water absorbing high-molecular substance in powder form is arranged to distributed throughout the layer of cotton or water absorbing paper. It is to be noted that the active adhesive may be applied all over the surface or it may be applied in part which is just sufficient for adhesion to the clothes. Alternatively, a plurality of double-coated tapes may be attached to the body 2. Of course, the adhesive must be one which does not cause any damage or stain in the clothes when the body is stripped off the clothes.

Figure 5:
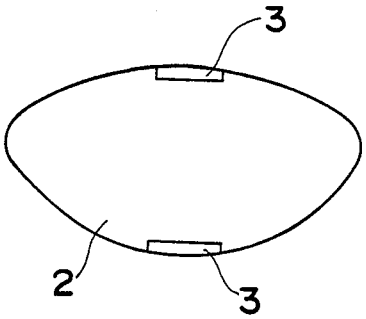
FIGS. 5, 6 and 7 are plan views showing other embodiments of the invention.
Figure 6:
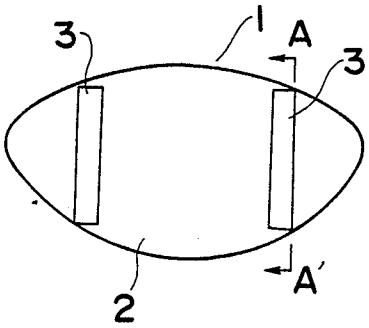
Figure 7:
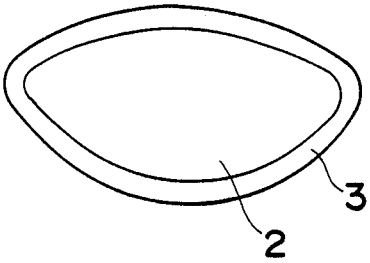

FIGS. 5, 6 and 7 show exemplary arrangements of the adhesive means 3. More specifically, in FIG. 5, a pair of adhesive portions are arranged at the opposing outer edge portions on one surface of the pad 2 which contacts the clothes, while, in FIG. 6, the adhesive means comprises a pair of strip adhesive portions arranged with a suitable space therebetween and each straightly connecting the opposing edge portions of the body 2. In FIG. 7, the adhesive means 3 comprises a strip adhesive portion of a suitable width which is arranged along the whole periphery of the outer margin of the pad body 2.

Figure 2:
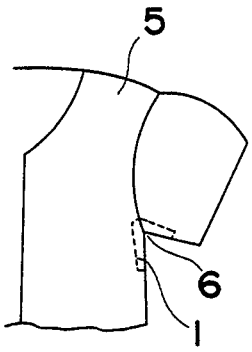
FIG. 2 is a schematic diagram showing the manner in which the pad is adhered to the underarm of a shirt.
Figure 3:
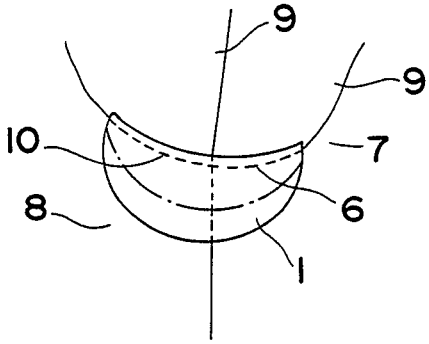
FIG. 3 is as partial enlarged view of FIG. 2 as seen from inside.

FIG. 2 shows the manner in which the pad 1 of this invention is stripped off the release paper 4 to expose the surface coated with the adhesive 3 and then attached to the innder side of an underarm 6 of a coat or shirt 5 in precaution against the perspiration from the armpit, and FIG. 3 shows the attached portion as seen from inside with numeral 7 designating the back cloth, 8 the front cloth and 9 the sleeve cloth.

Figure 4:
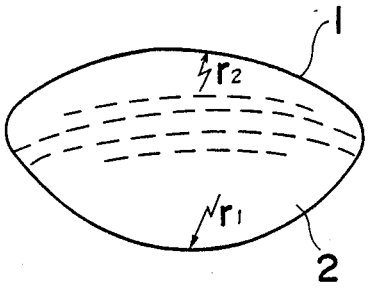
FIG. 4 is a plan view of a pad according to an embodiment of the invention.

FIG. 4 shows another embodiment of the pad of this invention in which at least one stitch or straight-line depression is formed along the fold line in substantially the central portion of one surface of the pad body 2 which contacts the skin so as to facilitate the folding of the pad 1 when attaching it to the clothes. Depending on the dimensions and thickness of the pad, a plurality of stitches or straight-line depressions may be formed and also the flexibility of the pad may be adjusted in depending on the spacing, number and length of the stiches or depressions. In addition, it is preferably to form the pad body 2 into substantially an oval shape and more preferably the ratio between its sleeve-side curvature $r_2$ and breast-side curvature $r_1$ should be selected $r_2 \geqq 1.5r_1$ in consideration of the fitness to the armpit and the adhesion to the clothes. Of course, the dimensions of the pad 1 must be sufficient to cover any of such portions which should be prevented from being stained. While pads of various sizes may be prepared, it is also possible to prepare a large-sized one so that one may cut the pad covered with the release paper into pieces of suitable sizes and carry them with one for use as occasions demand.

By impregnating the body 2 with a deodorant or perfume, it is possible to prevent the offensive smell of the armpit or alternatively the body 2 may be impregnated with a medicine so as to prevent the occurrence of prickly heat. Also, there is an advantage that the body 2 may have any color other than white, such as, pink, blue or green so as to be adhered in correspondence with the color of the clothes.

I claim:

1. A perspiration absorbing pad adapted for attachment to an underarm portion of one's clothes, said pad comprising:

a pad body including at least one layer of cotton or water absorbing paper and a layer of a water absorbing high-molecular material selected from the group consisting of starch-acrylonitrile, polyacrylic acid and starch-acrylic acid in powder or sheet form, said layers being formed into substantially an oval shape such that the ratio between a radius of curvature ($r_1$) forming an outer peripheral edge on one side of said oval shape and a radius of curvature ($r_2$) forming the opposing outer peripheral edge is $$r_2 \geqq 1.5r_1$$

and such that a whole exterior surface of said pad body is covered by a nonwoven fabric or water absorbing paper having a waterproof film formed on one surface thereof adapted for contact with said clothes; and adhesive means arranged on at least one portion of an outer surface of said pad body adapted for contact with said clothes.

2. A pad according to claim 1, wherein said adhesive means comprises a pair of strip-like adhesive portions arranged to have a suitable spacing therebetween and each thereof connecting the opposing outer edge portions on said outer surface of said pad body adapted for contact with said clothes.

3. A pad according to claim 1, wherein at least one stitch or linear depression is formed substantially on a central portion of that surface of said pad body adapted to contact with a skin along a bending line of said pad for wearing.

4. A pad according to claim 1, wherein at least the exterior surface of said pad body has substantially the same color as said clothes to which said pad body is attached.

5. A pad according to claim 1, wherein powdered or liquid deodorant and/or odor eliminator are added into said pad body.

6. A pad according to claim 1, wherein said waterproof film formed within said pad body is a gas permeable waterproof film.

7. A pad according to claim 1, wherein said adhesive means comprises an adhesive consisting of an epoxy resin.

8. A pad according to claim 1, wherein said layer of water absorbing material in powder or sheet form is arranged to be adjacent to an inner side of said water proof film.

9. A pad according to claim 1, wherein said layer of water absorbing material in powder or sheet form is arranged between at least two layers of cotton or water absorbing paper arranged on the inner side of said nonwoven fabric or water absorbing paper covering said whole exterior surface.

10. A pad according to claim 1, wherein said water absorbing material in powder form is arranged so as to be distributed throughout said at least one layer of cotton or water absorbing paper arranged on the inner side of said nonwoven fabric or water absorbing paper covering said whole exterior surface.

* * * * *